US008942590B2

(12) United States Patent
Furuichi

(10) Patent No.: US 8,942,590 B2
(45) Date of Patent: Jan. 27, 2015

(54) DEVELOPING APPARATUS, IMAGE FORMING APPARATUS AND PROCESS CARTRIDGE

(71) Applicant: Yuusuke Furuichi, Osaka (JP)

(72) Inventor: Yuusuke Furuichi, Osaka (JP)

(73) Assignee: Ricoh Company, Ltd., Tokyo (JP)

( * ) Notice: Subject to any disclaimer, the term of this patent is extended or adjusted under 35 U.S.C. 154(b) by 73 days.

(21) Appl. No.: 13/771,401

(22) Filed: Feb. 20, 2013

(65) Prior Publication Data

US 2013/0236209 A1 Sep. 12, 2013

(30) Foreign Application Priority Data

Mar. 6, 2012 (JP) ..... 2012-049160

(51) Int. Cl.
*G03G 15/08* (2006.01)

(52) U.S. Cl.
CPC ..... *G03G 15/0898* (2013.01)
USPC ..... 399/103

(58) Field of Classification Search
USPC ..... 399/103, 105
See application file for complete search history.

(56) References Cited

U.S. PATENT DOCUMENTS

| | | | | |
|---|---|---|---|---|
| 6,212,343 | B1 | 4/2001 | Hosokawa et al. | |
| 6,356,723 | B1 * | 3/2002 | Sato et al. | 399/103 |
| 6,496,669 | B2 * | 12/2002 | Sato et al. | 399/103 |
| 6,901,228 | B2 * | 5/2005 | Kamimura et al. | 399/103 |
| 2009/0285588 | A1 | 11/2009 | Furuichi et al. | |
| 2011/0058847 | A1 | 3/2011 | Furuichi et al. | |
| 2011/0062835 | A1 | 3/2011 | Idehara et al. | |
| 2011/0064456 | A1 | 3/2011 | Tada et al. | |
| 2011/0229197 | A1 | 9/2011 | Tada et al. | |
| 2012/0002997 | A1 | 1/2012 | Hiraoka et al. | |

FOREIGN PATENT DOCUMENTS

| | | |
|---|---|---|
| JP | 01-107277 | 4/1989 |
| JP | 04-174470 | 6/1992 |
| JP | 3825939 | 7/2006 |
| JP | 2011-017968 | 1/2011 |

* cited by examiner

*Primary Examiner* — Sandra Brase
(74) *Attorney, Agent, or Firm* — Harness, Dickey & Pierce, P.L.C.

(57) ABSTRACT

A developing apparatus, including: a developer container; a toner bearing member including a roller portion; a seal; a regulating member; and a development entrance sealing member, wherein the seal includes a contact portion which contacts the roller portion, wherein the contact portion includes a low-friction region including a material on at least a part of a contact surface with the roller portion, wherein the low-frictional region including the material has frictional resistance between the contact surface and the roller portion lower than frictional resistance between the contact portion without the material and the roller portion, and the material reduces the frictional resistance at the contact surface, and wherein a circumferential surface of the roller portion contacting the low-friction region is arranged to face outward in a longitudinal direction of the photoconductor from a contact region of the cleaning unit with the photoconductor.

15 Claims, 8 Drawing Sheets

Lens: X100

Lens: X100

-- PRIOR ART--

DEVELOPING APPARATUS, IMAGE FORMING APPARATUS AND PROCESS CARTRIDGE

BACKGROUND OF THE INVENTION

1. Field of the Invention

The present invention relates to a developing apparatus, an image forming apparatus and a process cartridge.

2. Description of the Related Art

As a developing apparatus to develop an electrostatic latent image formed on a photoconductor, there is a developing apparatus equipped with; a toner bearing member including a roller portion which supplies a toner in a developer container containing the toner; and a regulating member which contacts a surface of the toner bearing member and regulates an amount of the toner to be adhered.

In the developing apparatus where the adhered amount of the toner on the toner bearing member is regulated by the regulating member, the roller portion of the toner bearing member is arranged at a toner outlet of the developer container, and a shaft portion projected from both ends of the roller portion is rotatably supported by supporting walls provided on both sides of the developer container. Also, as for the regulating member, a lower edge of the regulating member is contacted by the roller portion of the toner bearing member such that a space between an upper edge of the toner outlet and an upper outer periphery of the toner bearing member is blocked.

In such a developing apparatus, to prevent toner leakage from the space between the outer periphery of the toner bearing member and the toner outlet, a development entrance sealing member which blocks a space between a lower edge of the toner outlet and a lower outer periphery of the roller portion of the toner bearing member is attached at a lower portion of the developer container. Also, to prevent toner leakage from both ends in a longitudinal direction of the toner bearing member, a development end sealing member (or simply a seal) which contacts the both ends of the toner bearing member surface as well as the both ends of the regulating member and the development entrance sealing member are arranged (for example, see Japanese Patent (JP-B) No. 3825939).

However, with such a sealing structure, the toner bearing member surface and the seal become sliding parts during rotation of the toner bearing member, causing frictional heat due to friction between the both members and melting a toner around them. Then, the melted toner is fixed on the regulating member and lifts the regulating member, and there has been a problem that a toner scatters from a gap between the lifted regulating member and the toner bearing member, resulting in an abnormal image. There has also been a problem that impurities generated by the toner bearing member surface and the seal contacting at the sliding parts inhibit normal image formation.

Accordingly, there currently is being asked to provide a developing apparatus which is able to prevent toner leakage as well as occurrence of abnormal image derived from a sealing structure.

SUMMARY OF THE INVENTION

The present invention aims at solving the above problems in the conventional technologies and at achieving the following objection. That is, the present invention aims at providing a developing apparatus which is able to prevent toner leakage as well as occurrence of abnormal image derived from a sealing structure.

Means for solving the problems are as follows. That is, a developing apparatus of the present invention is a developing apparatus used in an image forming apparatus including a photoconductor and a cleaning unit which removes a toner remaining on the photoconductor, wherein the developing apparatus includes:

a developer container with a toner outlet formed facing the photoconductor;

a toner bearing member including a roller portion arranged at the toner outlet, which bears a toner on a surface thereof and supplies the toner to an electrostatic latent image on a surface of the photoconductor in a developing region facing the photoconductor;

a seal arranged at both ends of the toner outlet so as to contact an outer periphery of the roller portion at both ends thereof in a longitudinal direction;

a regulating member which regulates an amount of the toner towards the developing region, wherein the regulating member is contacted by the roller portion such that a space between the toner outlet and the outer periphery of the roller portion is blocked in an upstream side from the developing region in a direction of rotation of the toner bearing member; and a development entrance sealing member contacted by the roller portion such that the space between the toner outlet and the outer periphery of the roller portion is blocked in a downstream side from the developing region in the direction of rotation of the toner bearing member, wherein the seal includes a contact portion which contacts the roller portion, wherein the contact portion includes a low-friction region including a material on at least a part of a contact surface with the roller portion, wherein the low-frictional region including the material has frictional resistance between the contact surface and the roller portion lower than frictional resistance between the contact portion without the material and the roller portion, and the material reduces the frictional resistance at the contact surface, and wherein a circumferential surface of the roller portion contacting the low-friction region is arranged to face outward in a longitudinal direction of the photoconductor from the contact region of the cleaning unit with the photoconductor.

According to the present invention, the conventional problems are solved, and a developing apparatus which is able to prevent toner leakage and prevent occurrences of an abnormal image derived from a sealing structure.

DETAILED DESCRIPTION OF THE INVENTION

Developing Apparatus

Figure 1:
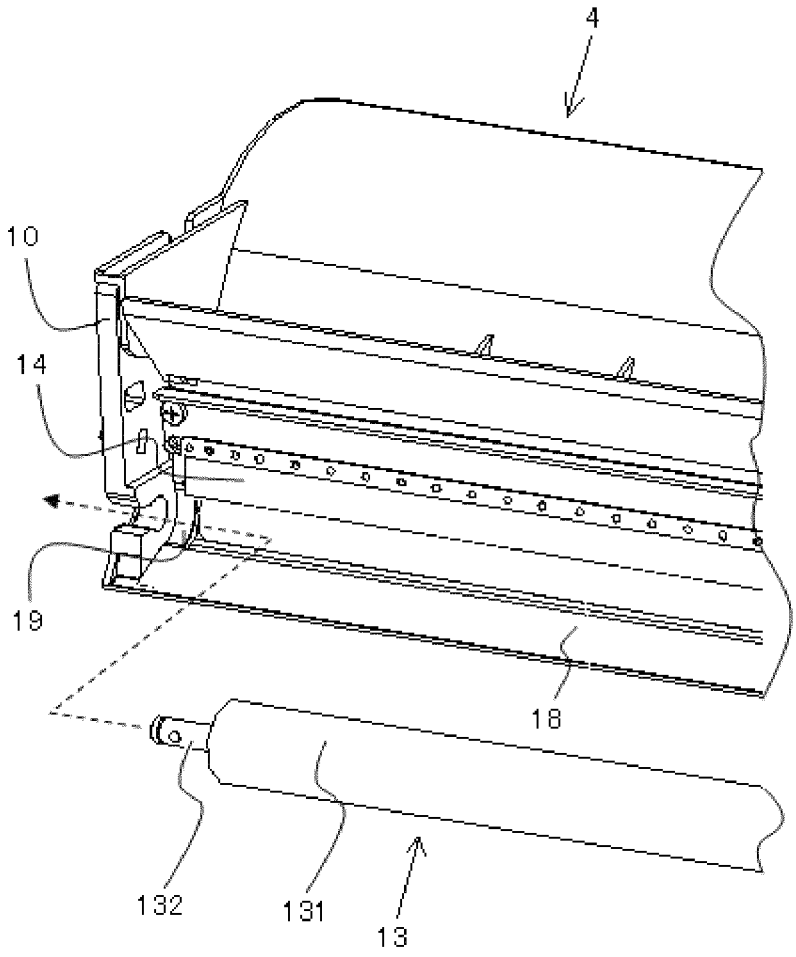
FIG. 1 is a schematic perspective diagram illustrating one example of a developing apparatus of the present invention.

A developing apparatus of the present invention includes at least: a developer container, a toner bearing member, a seal, a regulating member, and a development entrance sealing member, and it further includes other members according to necessity.

The developing apparatus is a developing apparatus used in an image forming apparatus including a photoconductor and a cleaning unit.

<Developer Container>

The developer container is not particularly restricted as long as it is a container with a toner outlet formed facing the photoconductor, and it may be appropriately selected according to purpose.

The developer container includes supporting walls provided on both sides of the toner outlet which support the toner bearing member.

The developer container is, for example, a housing of the entire developing apparatus, and it is provided inside with a toner supplying member and so on.

<Toner Bearing Member>

The toner bearing member includes a roller portion, and it further includes other members according to necessity.

The toner bearing member is not particularly restricted as long as it is a toner bearing member which bears a toner on a surface thereof and supplies the toner to an electrostatic latent image on a surface of the photoconductor in a developing region facing the photoconductor, and it may be appropriately selected according to purpose.

The toner bearing member, for example, moves endlessly with a toner borne on a surface thereof, and the toner is supplied to an electrostatic latent image on a surface of the photoconductor for development in a developing region facing the photoconductor.

—Roller Portion—

The roller portion is not particularly restricted as long as it is a roller portion arranged at the toner outlet, and it may be appropriately selected according to purpose.

Examples of the material of the roller portion include rubber and so on.

—Other Members—

Examples of the other members include a shaft portion and so on.

—Shaft Portion—

Regarding the shaft portion, a shape, a size and a structure thereof are not particularly restricted as long as it is a shaft portion rotatably supported by the supporting walls provided on both sides of the developer container, and it may be appropriately selected according to purpose.

Examples of a material of the shaft portion include metals and so on.

Specific examples of the toner bearing member include a toner bearing member which includes: the roller portion having an outer periphery formed of an elastic material having a low frictional coefficient such as rubber; and the shaft portion made of a metal which penetrates a center of the roller portion.

Also, the roller portion and the shaft portion may be integrally molded.

<Seal>

The seal is a sealing member provided at the both ends of the toner outlet so as to contact an outer periphery at both ends thereof in a longitudinal direction of the roller portion.

The seal includes a contact portion which contacts the roller portion.

The contact portion includes a low-friction region with a material on at least a part of a contact surface with the roller portion, wherein the low-frictional region with the material has a frictional resistance between the contact surface and the roller portion lower than frictional resistance between the contact portion without the material and the roller portion, and the material reduces the frictional resistance at the contact surface.

Then, a circumferential surface of the roller portion contacting the low-friction region of the seal is arranged so as to face outward in a longitudinal direction of the photoconductor from the contact region of the cleaning member with the photoconductor.

In a conventional sealing structure of a developing apparatus, large frictional heat is generated at a contact surface between a roller portion and a seal during rotation of a toner bearing member. Due to this frictional heat, a toner therearound melts, and the melted toner is fixed on a regulating member. Then, the regulating member is lifted to create a space between the regulating member and the roller portion. As a result, from the space, a toner in a developer container leaks to cause an abnormal image.

On the other hand, in the developing apparatus of the present invention, at the contact portion of the seal which contacts the roller portion, the contact portion includes a low-friction region with a material on at least a part of a contact surface with the roller portion, wherein the low-frictional region with the material has frictional resistance between the contact surface and the roller portion lower than frictional resistance between the contact portion with other material and the roller portion, and the material reduces frictional resistance at the contact surface. Thereby, frictional heat generated at the contact surface between the roller portion and the seal is reduced, preventing the toner from being melted by the frictional heat, and as a result, toner leakage from the developer container may be prevented.

Also, the entire contact portion configured with the material which reduces frictional resistance would be expensive, but in the developing apparatus, the material which reduces frictional resistance is included not in the entire contact portion but only in at least a part of the contact surface with the roller portion. Thereby, increase in cost may be suppressed.

Further, a circumferential surface of the roller portion contacting the low-friction region of the seal is arranged so as to face outward in a longitudinal direction of the photoconductor from the contact region of the cleaning unit with the photoconductor. Thereby, even though the material which reduces the frictional resistance is worn, peeled off or desorbed by sliding, is deposited as a deposit on the surface of the roller portion which contacts the contact surface, or is further transferred to the surface of the photoconductor which contacts the surface of the roller portion, it is possible to prevent the deposit from being spread by the cleaning member and depositing on an image forming region on the surface of the photoconductor since the deposit is present outside the contact region of the cleaning member. Thus, an abnormal image due to the deposit may be prevented.

A material of the contact portion is not particularly restricted and may be appropriately selected according to purpose. Nonetheless, felt is preferable. In other words, the contact portion is preferably formed using felt.

The material which reduces frictional resistance is not particularly restricted and it may be appropriately selected according to purpose. Nonetheless, it is preferably a fluorine-based resin.

A method for forming the low-friction region is not particularly restricted and may be appropriately selected according to purpose. Examples thereof include a method of coating a liquid including the fluorine-based resin as the material which reduces frictional resistance to a region to be the low-friction region.

The liquid including the fluorine-based resin is not particularly restricted and may be appropriately selected according to purpose. For example, commercial products may be used. Examples of the commercial products include DRYSURF manufactured by HARVES Co., Ltd. and so on.

The contact portion of the seal contacts, for example, the regulating member. In this case, a contact pressure between the contact portion and the regulating member is preferably smaller than a contact pressure between the contact portion and the roller portion. Thereby, a contact pressure of the entire seal may be reduced, which enables further reduction of frictional heat.

Also, the seal preferably includes: a high-resilience portion having a large repulsive force at contact between the roller portion and the contact portion; and a low-resilience portion having a smaller repulsive force than the high-resilience portion at contact between the regulating member and the contact portion. In other words, at the contact portion, the seal preferably includes a first resilient portion and a second resilient portion which generate repulsive forces at contact with the roller portion, wherein the second resilient portion preferably generates a smaller repulsive force than the first resilient portion. Thereby, a contact pressure of the entire seal is reduced, which may further reduce the frictional heat.

<Regulating Member>

The regulating member is a member contacted by the roller portion such that the space between the toner outlet and the outer periphery of the roller portion is blocked in an upstream side from the developing region in a direction of rotation of the toner bearing member.

Also, the regulating member is a member which regulates an amount of the toner towards the developing region by contacting the surface of the toner bearing member.

Examples of the regulating member include a member as a plate-like member with one end thereof supported by a support member and a free end thereof contacting the surface of the toner bearing member, which thereby regulates the amount of the toner towards the developing region.

Specific examples of the regulating member include a doctor blade and so on.

A material of the regulating member is not particularly restricted and may be appropriately selected according to purpose. Examples thereof include metals and so on. Examples of the metals include stainless steel (SUS), phosphor bronze and so on.

A shape, a size and a structure of the regulating member are not particularly restricted and may be appropriately selected according to purpose.

<Development Entrance Sealing Member>

The development entrance sealing member is not particularly restricted as long as it is a member contacted by the roller portion such that the space between the toner outlet and the outer periphery of the roller portion is blocked in a downstream side from the developing region in a direction of rotation of the toner bearing member, and it may be appropriately selected according to purpose.

<Photoconductor>

A material, a shape, a structure and a size of the photoconductor are not particularly restricted, and they may be appropriately selected from heretofore known ones. A drum shape is a favorable shape thereof. As the material, for example, an inorganic photoconductor such as amorphous silicon and selenium and an organic photoconductor such as polysilane and phthalopolymethine may be exemplified. Among these, in view of longevity, amorphous silicon is preferable.

As the amorphous-silicon photoconductor, for example, a photoconductor including a photoconductive layer composed of a-Si formed by heating a substrate to 50° C. to 400° C. and forming a film on the substrate by a film formation method such as vacuum deposition method, sputtering method, ion-plating method, thermal-CVD (Chemical Vapor Deposition) method, photo-CVD method and plasma CVD method. Among these, the plasma CVD method, where a raw-material gas is decomposed by a direct-current or a high-frequency or microwave glow discharge to form a deposited film of a-Si on the substrate, is preferable.

The shape of the photoconductor is not particularly restricted and may be appropriately selected according to purpose. Nonetheless, a cylindrical shape is preferable. An outer diameter of the cylindrical photoconductor is not particularly restricted and may be appropriately selected according to purpose. Nonetheless, it is preferably 3 mm to 100 mm, more preferably 5 mm to 50 mm, and particularly preferably 10 mm to 30 mm.

<Cleaning Unit>

The cleaning unit is not particularly restricted as long as it is a means for removing the toner remaining on the photoconductor, and it may be appropriately selected according to purpose. Examples thereof include a magnetic brush cleaner, an electrostatic brush cleaner, a magnetic roller cleaner, a blade cleaner, a brush cleaner, a web cleaner and so on.

The cleaning unit is in contact with the photoconductor.

(Image Forming Apparatus, Image Forming Method, Process Cartridge)

An image forming apparatus of the present invention includes at least a photoconductor, a developing unit and a cleaning unit, and it further includes other units according to necessity.

The image forming method relating to the present invention includes at least a developing step and a cleaning step, and it further includes other steps according to necessity.

A process cartridge of the present invention includes at least a photoconductor and the developing apparatus of the present invention, and it further includes other units according to necessity.

The image forming method may be favorably carried out by the image forming apparatus, the developing step may be carried out by the developing unit, and the cleaning step may be carried out by the cleaning unit.

The process cartridge may be detachably attached to various image forming apparatuses, and it is preferable that the process cartridge is detachably attached to the image forming apparatus of the present invention described above.

<Photoconductor>

The photoconductor is the photoconductor described in the explanation of the developing apparatus.

<Developing Unit and Developing Step>

The developing unit is a developing unit which forms a visible image by developing the electrostatic latent image formed on the photoconductor and which includes a toner. It is not particularly restricted as long as it is the developing apparatus of the present invention, and it may be appropriately selected according to purpose.

The developing step is not particularly restricted as long as it is a step for developing the electrostatic latent image formed on the photoconductor using a toner to form a visible image, and it may be appropriately selected according to purpose. For example, it may be carried out by the developing unit.

<Cleaning Unit and Cleaning Step>

The cleaning unit is the cleaning unit described in the explanation of the developing apparatus.

The cleaning step is not particularly restricted as long as it is a step which may remove the toner remaining on the photoconductor, and it may be appropriately selected according to purpose. For example, it may be carried out by the cleaning unit.

<Other Units and Other Steps>

—Electrostatic Latent Image Forming Unit and Electrostatic Latent Image Formation Step—

An electrostatic latent image forming unit is not particularly restricted as long as it is a unit for forming an electrostatic latent image on the photoconductor, and it may be appropriately selected according to purpose. Examples thereof include a unit which includes at least a charging member which charges the surface of the photoconductor and an exposure member which carries out an imagewise exposure on the surface of the photoconductor.

An electrostatic latent image formation step is not particularly restricted as long as it is a step for forming an electrostatic latent image on the photoconductor, and it may be appropriately selected according to purpose. For example, it may be carried out by charging the surface of the photoconductor followed by imagewise exposure, and it may be carried out using the electrostatic latent image forming unit.

—Charging Member and Charging—

The charging member is not particularly restricted and may be appropriately selected according to purpose. Examples thereof include: a contact charger heretofore known per se equipped with electrically conductive or semiconductive roller, brush, film, rubber blade and so on; and a non-contact charger which makes use of corona discharge such as corotron, scorotron and so on.

The charging may be carried out by applying a voltage on a surface of the photoconductor using, for example, the charging member.

The charging member may be in any shape, in addition to a roller, such as magnetic brush, fur brush and so on, and it may be selected according to specifications and shapes of the image forming apparatus.

In a case where the magnetic brush is used as the charging member, the magnetic brush is composed of various ferrite particles such as Zn—Cu ferrite used as a charging member; a non-magnetic, electrically conductive sleeve for supporting this; and a magnet roller encapsulated thereby.

In a case where the fur brush is used as the charging member, by using a fur subjected to an electroconductive treatment with a material of the fur brush such as carbon, copper sulfide, metal or a metal oxide and wrapping or pasting this on a metal or other cored bar subjected to an electroconductive treatment, a charging member may be obtained.

The charging member is not restricted to the contact charging member, but it is preferable to use the contact charging member since an image forming apparatus with reduced ozone generated from the charging member may be obtained.

—Exposure Member and Exposure—

The exposure member is not particularly restricted as long as it may carry out imagewise exposure on the surface of the photoconductor charged by the charging member, and it may be appropriately selected according to purpose. Examples thereof include various exposure members such as duplication optical system, rod lens array system, laser optical system, liquid crystal shutter optical system and so on.

A light source used for the exposure member is not particularly restricted and may be appropriately selected according to purpose. Examples thereof include general light-emitting elements such as fluorescent lamp, tungsten lamp, halogen lamp, mercury lamp, sodium lamp, light-emitting diode (LED), laser diode (LD), electroluminescence (EL) and so on.

Also, in order to irradiate a light in a desired wavelength region, various filters such as sharp-cut filter, bandpass filter, near-infrared cut filter, dichroic filter, interference filter, light-balancing filter and so on may be used.

The exposure may be carried out by imagewise exposure on the surface of the photoconductor using the exposure member, for example.

Here, in the present invention, a back light system that imagewise exposure is carried out from a back side of the photoconductor may be employed.

—Transfer Unit and Transfer Step—

A transfer unit is not particularly restricted as long as it is a unit for transferring the visible image to a recording medium, and it may be appropriately selected according to purpose. For example, an embodiment including a primary transfer unit which forms a composite transfer image by transferring the visible image on an intermediate transfer body and a secondary transfer unit which transfers the composite transfer image on the recording medium is preferable.

A transfer step is not particularly restricted as long as it is a step for transferring the visible image on the recording medium, and it may be appropriately selected according to purpose. Nonetheless, a preferable aspect includes primary transfer of a visible image on the intermediate transfer body using the intermediate transfer body followed by secondary transfer of the visible image on the recording medium.

The transfer step may be carried out, for example, by charging the photoconductor by a transfer charger, and it may be carried out by the transfer unit.

Here, in a case where the image transferred on the recording medium as the secondary transfer is a color image composed of toners of a plurality of colors, the transfer may be configured such that the toners of the respective colors are sequentially transferred on the intermediate transfer body by the transfer unit to form an image on the intermediate transfer body and that the image on the intermediate transfer body is transferred at once as the secondary transfer by the intermediate transfer unit.

Here, the intermediate transfer body is not particularly restricted, and it maybe appropriately selected from heretofore known transfer bodies according to purpose. Favorable examples include a transfer belt and so on.

The transfer unit (the primary transfer unit, the secondary transfer unit) preferably includes at least a transfer device which peels and charges the visible image formed on the photoconductor to a side of the recording medium. Examples of the transfer device include a corona transfer device by corona discharge, a transfer belt, a transfer roller, a pressure transfer roller, an adhesive transfer device and so on.

Here, the recording medium is typically plain paper, but it is not particularly restricted as long as a non-fixed image after development may be transferred on the medium, and it may be appropriately selected according to purpose. It is also possible to use a PET base for OHP.

—Fixing Unit and Fixing Step—

A fixing unit is not particularly restricted as long as it is a unit for fixing a transfer image transferred on the recording medium, and it may be appropriately selected according to purpose. Nonetheless, a heretofore known heating and pressurizing member is preferable. Examples of the heating and pressurizing member include a combination of a heat roller and a pressure roller, a combination of a heat roller, a pressure roller and an endless belt, and so on.

A fixing step is not particularly restricted as long as it is a step for fixing the visible image transferred on the recording medium, and it may be appropriately selected according to purpose. For example, it may be carried out every time the toner of a respective color is transferred on the recording medium, or it may be carried out once when the toners of respective colors are laminated.

The fixing step may be carried out by the fixing unit.

Preferably, heating by the heating and pressurizing member is usually 80° C. to 200° C.

Here, in the present invention, a heretofore known light fixing device in combination with or in place of the fixing unit may be used according to purpose.

A surface pressure in the fixing step is not particularly restricted, and it may be appropriately selected according to purpose. Nonetheless, it is preferably 10 $N/cm^2$ to 80 $N/cm^2$.

—Neutralizing Unit and Neutralizing Step—

A neutralizing unit is not particularly restricted as long as it is a unit for neutralizing the photoconductor by applying a neutralizing bias thereon, and it may be appropriately selected according to purpose. Examples thereof include a neutralizing lamp and so on.

A neutralizing step is not particularly restricted as long as it is a step for neutralizing the photoconductor by applying a neutralizing bias thereon, and it may be appropriately selected according to purpose. For example, it may be carried out by the neutralizing unit.

—Recycling Unit and Recycling Step—

A recycling unit is not particularly restricted as long as it recycles the toner removed by the cleaning step to the developing apparatus, and it may be appropriately selected according to purpose. Examples thereof include heretofore known conveying units.

A recycling step is not particularly restricted as long as it is a step for recycling the toner removed by the cleaning step to the developing apparatus, and it may be appropriately selected according to purpose. For example, it may be carried out by the recycling unit.

—Controlling Unit and Controlling Step—

A controlling unit is not particularly restricted as long as it controls operations of the various units, and it may be appropriately selected according to purpose. Examples thereof include devices such as sequencer, computer and so on.

A controlling step is not particularly restricted as long as it is a step for controlling operations of the various steps, and it may be appropriately selected according to purpose. For example, it may be carried out by the controlling unit.

[Developing Apparatus]

Hereinafter, one embodiment of the developing apparatus of the present invention is explained in more detail using figures.

FIG. 1 is a schematic perspective diagram illustrating one example of a developing apparatus of the present invention. A developing apparatus 4 illustrated in FIG. 1 includes: a developer container 10 having a toner outlet formed facing a photoconductor; a toner bearing member 13 including a shaft portion 132 rotatably supported by supporting walls provided on both sides of the developer container 10 and a roller portion 131 arranged at the toner outlet; a seal 19 arranged at both ends of the toner outlet so as to contact an outer periphery of the roller portion 131 at both ends in a longitudinal direction; a regulating member 14 which is contacted by the roller portion 131 such that a space between the toner outlet and the outer periphery of the roller portion 131 is blocked in an upstream side from a developing region in a direction of rotation of the toner bearing member 13 where the toner bearing member 13 faces the photoconductor and regulates an amount of the toner towards the developing region; and a development entrance sealing member 18 which is contacted by the roller portion 131 such that the space between the toner outlet and the outer periphery of the roller portion 131 of the toner bearing member 13 is blocked in a downstream side from the developing region in the direction of rotation of the toner bearing member 13.

In FIG. 1, the toner bearing member 13 is inserted in a direction of a dashed arrow, and thereby it is rotatably supported by the supporting walls. At that time, the seal 19 is compressed and contacts the roller portion 131 at a predetermined contact pressure. Thereby, the roller portion is sealed around the both ends, and toner leakage from the developer container 10 is prevented.

Figure 2:
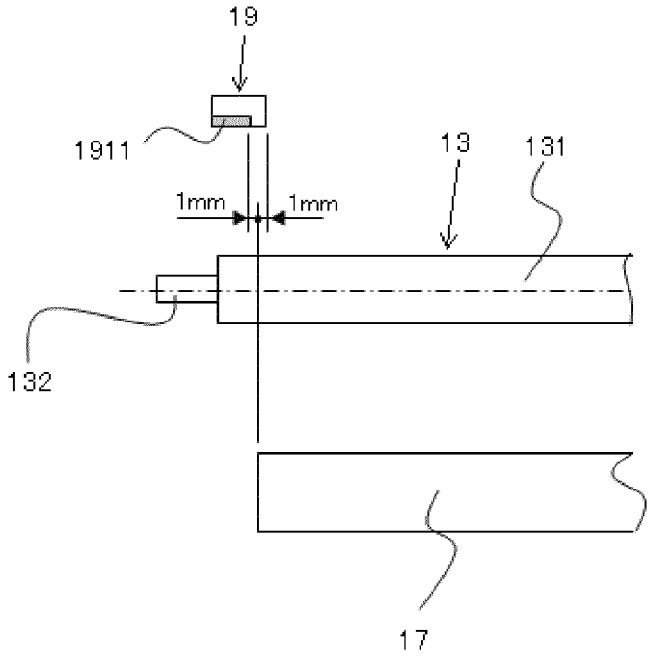
FIG. 2 is a schematic diagram illustrating one example of a positional relationship among a toner bearing member, a seal and a cleaning unit.

FIG. 2 is a schematic diagram illustrating one example of a positional relationship among a toner bearing member 13, a seal 19 and a cleaning blade 17 (the figure illustrates only a left side, but a right side is similar). The toner bearing member 13 includes a roller portion 131 composed of a rubber and a shaft portion 132 composed of a metal. The seal 19 is located at an end in a longitudinal direction of the roller portion 131. Also, a low-friction region 1911 is formed at a part of the seal 19. In this embodiment, using DRYSURF manufactured by HARVES Co., Ltd. (including a fluorine-based resin) as a coating material, the coating material is coated on felt of the seal 19. Thereby, the low-friction region 1911 at which the felt is coated with the fluorine-based resin is formed. A frictional coefficient between the low-friction region 1911 and the roller portion 131 is lower than a frictional coefficient between a non-coated portion of the felt and the roller portion 131. Thereby, the contact pressure may be reduced; in other words, the frictional heat may be reduced without sacrificing sealing property.

However, the present inventors have confirmed that, only with this configuration, a part of components of the coated fluorine-based resin is transferred to the photoconductor after printing about 5,000 sheets and that the components of the fluorine-based resin moved to the photoconductor is further spread inward in an axial direction of the photoconductor while being scraped by the cleaning blade 17. After the photoconductor in that state is stored for 3 or more days, a part of components of the fluorine-based resin alters the photoconductor, and white streaks occur at both ends of an image in a cycle around the photoconductor. Thus, in the present embodiment, a length of the cleaning blade 17 is set to be 1 [mm] inside from the low-friction region 1911. In other words, a circumferential surface of the roller portion 131 which contacts the low-friction region 1911 of the seal 19 is arranged so as to face outward in a longitudinal direction of the photoconductor from the contact region of the cleaning blade 17 with the photoconductor. Here, in the roller portion 131, in order to clean surely a toner which is adhered on a toner bearing portion (portion not in contact with the seal 19) and adhered on the photoconductor as background smear, the cleaning blade 17 is preferably configured such that side edges of the cleaning blade 17 is corresponding to the seal 19 and the side edges of the cleaning blade 17 is not in contact with an inner side of the seal 19 (outside by 1 [mm] in the present embodiment). Thereby, occurrences of an abnormal image may be suppressed while reducing frictional heat at the ends of the roller portion 131.

Figure 3:
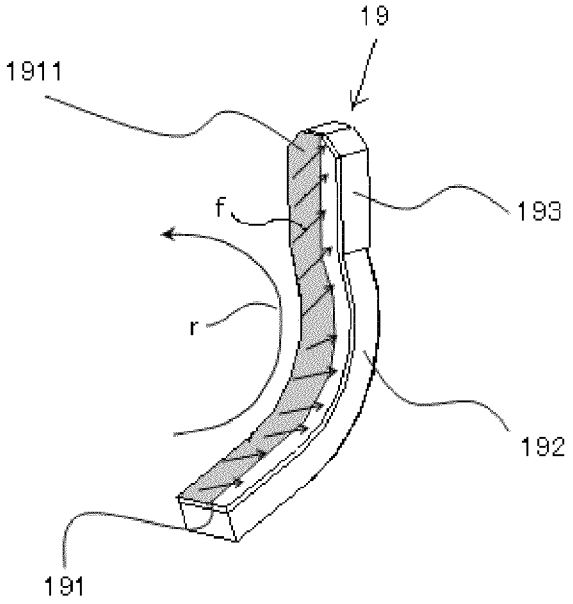
FIG. 3 is a schematic perspective diagram of one example of a seal.

FIG. 3 is a schematic perspective diagram illustrating one example of a seal. The seal 19 includes a contact portion 191 which is composed of felt contacting the roller portion, a high-resilience portion (first resilient portion) 192 which generates a predetermined reaction force when it is compressed by a predetermined amount, and a low-resilience portion (second resilient portion) 193 which generates a reaction force weaker than that of the high-resilience portion (first resilient portion) 192 when it is compressed by a predetermined amount. The contact portion 191 includes a low-friction region 1911 at a portion of a contact surface with the roller portion, which is coated with a fluorine-based resin that reduces frictional resistance than frictional resistance between the felt and the roller portion.

A direction of fibers of the felt at the contact portion 191 is between a direction same as a direction of rotation of the roller portion at the contact surface (arrow r) and a direction inward the developer container in an axial direction of the toner bearing member (arrow f). Thereby, when the roller portion rotates, the fibers are lying in a right oblique direction, and the toner is less likely to intrude from a right side. Thereby, it is possible to seal by contacting with a smaller contact pressure, and it is possible to reduce frictional heat as well by reducing the contact pressure.

Figure 4:
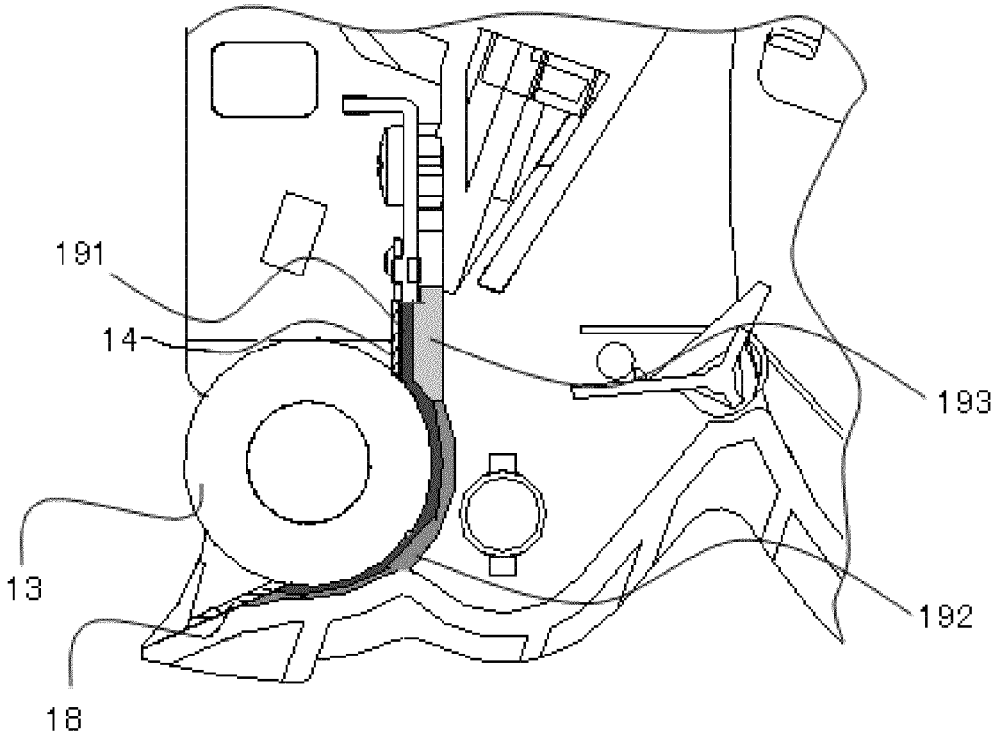
FIG. 4 is a schematic cross-sectional diagram illustrating one example of an end portion of a developing apparatus of the present invention.

FIG. 4 is a schematic cross-sectional diagram illustrating one example of an end portion of a developing apparatus of the present invention. At a lower side of a roller portion, the toner outlet is blocked by a development entrance sealing member 18. Also, an upper side of the roller portion is contacted by a regulating member 14, and the toner outlet is blocked by the regulating member 14. A right side of a toner bearing member 13 is contacted by a compressed high-resilience portion (first resilient portion) 192 of a seal. A portion contacting the regulating member 14 is contacted by a compressed low-resilience portion (second resilient portion) 193 of the seal. A relatively high pressure is necessary for the contacts with the roller portion since it rotates, but it is possible to seal with a low contact pressure since the regulating member 14 does not migrate. Accordingly, frictional heat may be reduced by partially reducing the contact pressure.

[Image Forming Apparatus]

Hereinafter, using a figure, one embodiment of the image forming apparatus of the present invention is explained in more detail.

Figure 5:
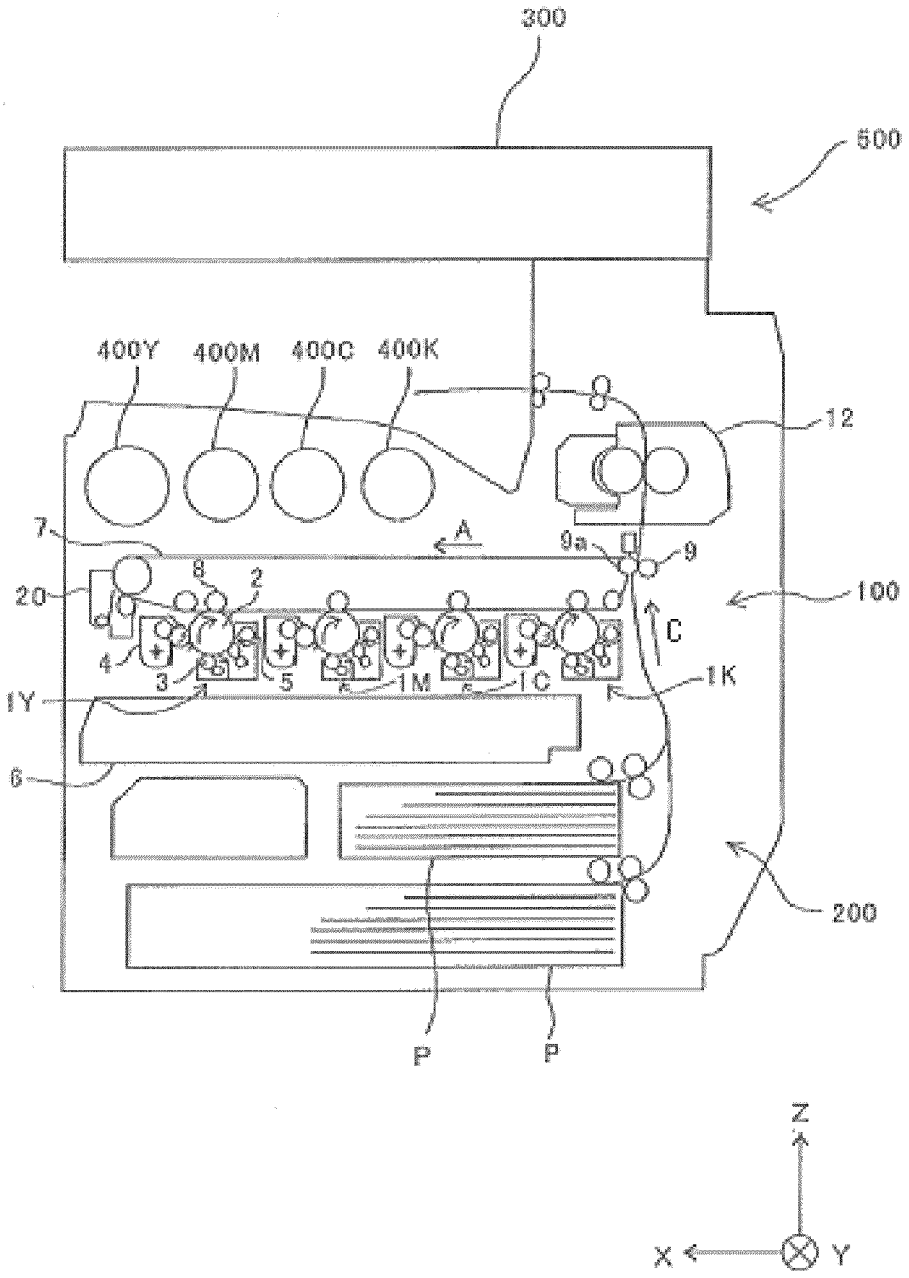
FIG. 5 is a schematic configuration diagram illustrating one example of an image forming apparatus of the present invention.

FIG. 5 is a schematic cross-sectional diagram illustrating one example of an image forming apparatus of the present invention. A copying machine 500 in FIG. 5 is composed of a copying apparatus main body (hereinafter referred to as a printer unit 100), a paper-feed table (hereinafter referred to as a paper-feed unit 200) and a scanner attached on the printer unit 100 (hereinafter referred to as a scanner unit 300).

The printer unit 100 is equipped with four process cartridges 1 (1Y, 1M, 1C, 1K) as process units, an intermediate transfer belt 7 as an intermediate transfer body which is stretched by a plurality of stretch rollers and moves in a direction of an arrow A in FIG. 5, an exposure apparatus 6, a fixing apparatus 12 and so on.

The additional characters Y, M, C and K added after the reference numeral of the four process cartridges indicate that they are specific for yellow, magenta, cyan and black, respectively. The four process cartridges (1Y, 1M, 1C, 1K) have almost the same configuration except that the toners used have different colors, and thus, the additional characters K, Y, M and C are omitted in the following explanation.

The process cartridge 1 is configured to integrally support a photoconductor 2, a charging member 3, a developing apparatus 4 and a cleaning unit 5 as a unit. Each process cartridge 1 may be detached from the copying machine 500 main body by releasing a stopper not shown.

The photoconductor 2 rotates in a clockwise direction as illustrated by an arrow in the figure. The charging member 3 is a roller-shaped charging roller, contacting with pressure on a surface of the photoconductor 2, and it is driven to rotate by a rotation of the photoconductor 2. During image formation, a predetermined bias is applied on the charging member 3 from a high-voltage power supply not shown, and the surface of the photoconductor 2 is charged. In the process cartridge 1, a roller-shaped charging member which contacts the surface of the photoconductor 2 is used as the charging member 3. However, the charging member is not limited thereto, and a non-contact charging method such as corona charging and so on may also be used.

The exposure apparatus 6 exposes the surface of the photoconductor 2 based on image information of a document image read by the scanner unit 300 or image information input from an external device such as personal computer, and an electrostatic latent image is formed on the surface of the photoconductor 2. The exposure apparatus 6 equipped in the printer unit 100 employs a laser beam scanner method using a laser diode, but as the exposure member may have other configurations such as using an LED array.

The cleaning unit 5 cleans a residual toner remaining after transfer on the surface of the photoconductor 2 which has passed a location facing the intermediate transfer belt 7.

Each of the four process cartridges 1 forms a toner image (visible image) of respective colors, yellow, cyan, magenta and black, on the photoconductors 2. The four process cartridges 1 are arranged in parallel on a surface of the intermediate transfer belt 7 in a conveying direction, and the toner images formed on the respective photoconductors 2 are sequentially transferred so as to be superimposed on the intermediate transfer belt 7, and a visible image is formed on the intermediate transfer belt 7.

In FIG. 5, a primary transfer roller 8 is provided as a primary transfer unit at a location facing each photoconductor 2 via the intermediate transfer belt 7. A primary transfer bias is applied on the primary transfer roller 8 from a high-voltage power supply not shown, and a primary transfer electric field is formed between the primary transfer roller 8 and the photoconductor 2. By the primary transfer electric field formed between the photoconductor 2 and the primary transfer roller 8, the toner image formed on the surface of the photoconductor 2 is transferred on the surface of the intermediate transfer belt 7. By one of the plurality of the stretch rollers which stretch the intermediate transfer belt 7 being rotated by a drive motor not shown, the intermediate transfer belt 7 is subjected to surface movement in a direction of an arrow A in the figure. The toner images of the respective colors are sequentially transferred and overlaid on the intermediate transfer belt 7 in surface movement, and thereby a full-color image is formed on the surface of the intermediate transfer belt 7.

In a downstream side of the surface movement direction of the intermediate transfer belt 7 with respect to a location at which the four process cartridges 1 are facing the intermediate transfer belt 7, a secondary transfer roller 9 is provided at a location facing a secondary transfer counter roller 9*a* as one of the stretch rollers via the intermediate transfer belt 7, and it forms a secondary transfer nip with the intermediate transfer belt 7. By applying a predetermined voltage between the secondary transfer roller 9 and the secondary transfer counter roller 9*a*, and a secondary transfer electric field is formed. When transfer paper P as a transfer medium fed from the paper-feed unit 200 and conveyed in a direction of an arrow C in FIG. 5 passes the secondary transfer nip, the full-color image formed on the surface of the intermediate transfer belt 7 is transferred to the transfer paper P by the secondary transfer electric field formed between the secondary transfer roller 9 and the secondary transfer counter roller 9*a*.

A fixing apparatus 12 is provided at a downstream side in a conveying direction of the transfer paper P with respect to the secondary transfer nip. The transfer paper P which has passed the secondary transfer nip reaches the fixing apparatus 12. The full-color image transferred on the transfer paper P is fixed by heating and pressurization in the fixing apparatus 12, and the transfer paper P with the fixed image is discharged outside the copying machine 500.

Meanwhile, a toner remaining on the surface of the intermediate transfer belt 7 without being transferred to the transfer paper P at the secondary transfer nip is recovered by a transfer belt-cleaning apparatus 20.

As illustrated in FIG. 5, toner bottles (400Y, 400M, 400C, 400K) which contain toners of respective colors are provided above the intermediate transfer belt 7 in a detachable manner to the copying machine 500.

Toners contained in the toner bottles of respect colors (400Y, 400M, 400C, 400K) are supplied to the developing apparatuses 4 of respective colors by toner replenishing apparatuses of corresponding respective colors (not shown).

[Process Cartridge]

Hereinafter, using a figure, one embodiment of the process cartridge of the present invention is explained in more detail.

Figure 6:
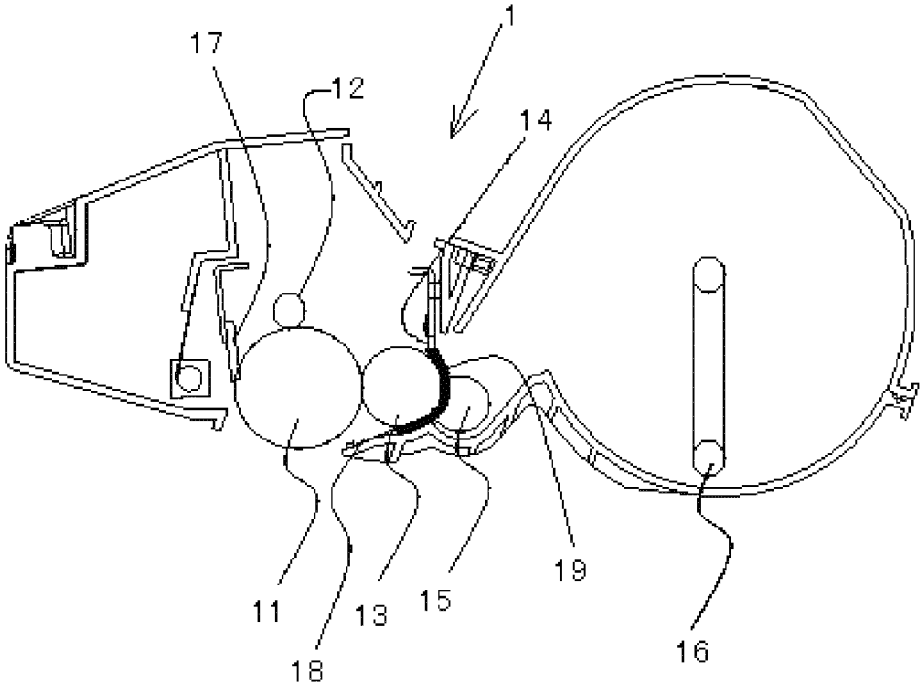
FIG. 6 is a schematic configuration diagram illustrating one example of a process cartridge of the present invention.

FIG. 6 is a schematic cross-sectional diagram illustrating one example of a process cartridge of the present invention. A process cartridge 1 includes a photoconductor 11, a charging member 12, a cleaning blade 17 as a cleaning unit and a developing apparatus. The developing apparatus includes: a toner bearing member 13 which supplies a predetermined amount of a toner to the photoconductor 11; a regulating member 14 which controls an amount of the toner on the toner bearing member 13; a development entrance sealing member 18 which prevents the toner from leaking from a toner outlet of the developing apparatus; a seal 19; a supply roller 15 which supplies the toner to the toner bearing member 13; and an agitator 16 which supplies the toner to the supply roller 15 while stirring the toner.

EXAMPLES

Hereinafter, examples of the present invention are explained. These examples, however, shall not be construed as limiting the scope of the present invention.

Example 1

Using an image forming apparatus including a developing apparatus with a configuration of the present invention illustrated in FIG. 1 to FIG. 4, a seal was measured for its temperature changes, and a photoconductor was observed.

Specifically, the seal 19 illustrated in FIG. 3 was used in the configuration of the developing apparatus illustrated in FIG. 1. The seal 19 included the contact portion 191 which was composed of felt contacting the roller portion, the high-resilience portion (first resilient portion) 192 which generated a predetermined reaction force when it was compressed by a predetermined amount, and the low-resilience portion (second resilient portion) 193 which generated a reaction force weaker than that of the high-resilience portion (first resilient portion) 192 when it was compressed by a predetermined amount. The contact portion 191 included the low-friction region 1911 at a portion of a contact surface with the roller portion, which was coated with a fluorine-based resin that reduced frictional resistance than frictional resistance between the felt and the roller portion.

PORON LE-20 (manufactured by INOAC Corporation) was used for the high-resilience portion (first resilient portion) 192. RIAL SEALER RGZ (manufactured by Bridgestone Diversified Chemical Products Co., Ltd.) was used for the low-resilience portion (second resilient portion) 193. The low-friction region 1911 was formed by coating the felt with DRYSURF MF-2400EL, manufactured by HARVES Co., Ltd. (liquid including a fluorine-based resin).

Figure 7:
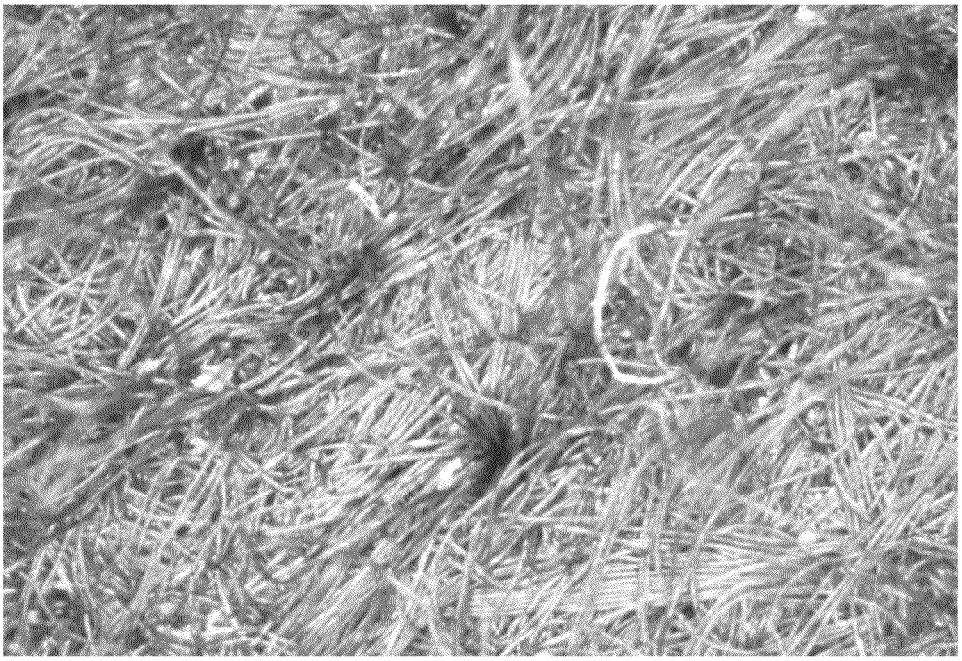
FIG. 7 is a photograph illustrating a condition of felt before application of a fluorine-based resin on the felt in Example 1.
Figure 8:
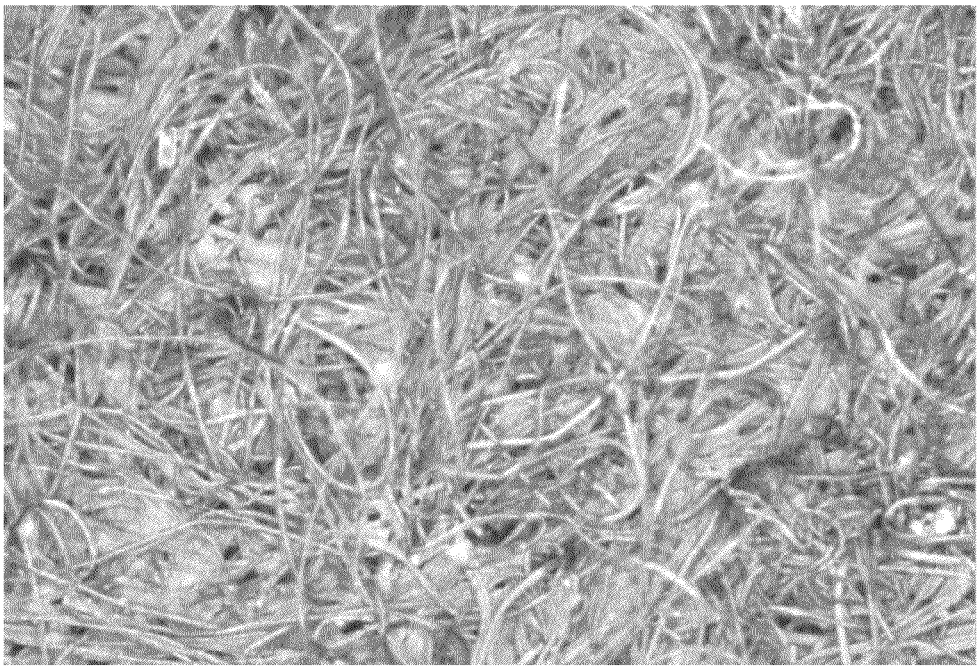
FIG. 8 is a photograph illustrating a condition of felt after application of a fluorine-based resin on the felt in Example 1.

Here, FIG. 7 illustrates a condition of the felt before application of the fluorine-based resin on the felt. Also, FIG. 8 illustrates a condition of the felt after application of the fluorine-based resin on the felt. Before application of the fluorine-based resin (FIG. 7), fibers of the felt were partially standing on a surface of the felt. On the other hand, after application of the fluorine-based resin (FIG. 8), the fibers on the surface of the felt were lying due to application of the viscous fluorine-based resin.

Also, the toner bearing member 13, the seal 19, and the cleaning blade 17 were configured to have a positional relationship in a longitudinal direction illustrated in FIG. 2. That is, the seal 19 was located at an end portion of the roller portion 131 in a longitudinal direction. Moreover, a circumferential surface of the roller portion 131 which contacted the low-friction region 1911 of the seal 19 was arranged so as to face outward in a longitudinal direction of the photoconductor from the contact region of the cleaning blade 17 with the photoconductor. Here, the end portion of the cleaning blade 17 was configured to be inside from the low-friction region 1911 (in this example, inside by 1 [mm]). Also, in the roller portion 131, in order to clean surely a toner which was adhered on a toner bearing portion (portion not in contact with the seal 19) and adhered on the photoconductor as background smear, the cleaning blade 17 was configured such that side edge of the cleaning blade 17 was corresponding to the seal 19 and the side edges of the cleaning blade was not in contact with an inner side of the seal 19 (outside by 1 [mm] in the present embodiment).

Also, as illustrated in FIG. 4, at a lower side of a roller portion, the toner outlet was blocked by a development entrance sealing member 18. Also, an upper side of the roller portion was contacted by a regulating member 14, and the toner outlet was blocked by the regulating member 14. A right side of a toner bearing member 13 was contacted by a compressed high-resilience portion (first resilient portion) 192 of a seal. A portion contacting the regulating member 14 was contacted by a compressed low-resilience portion (second resilient portion) 193 of the seal.

Figure 9:
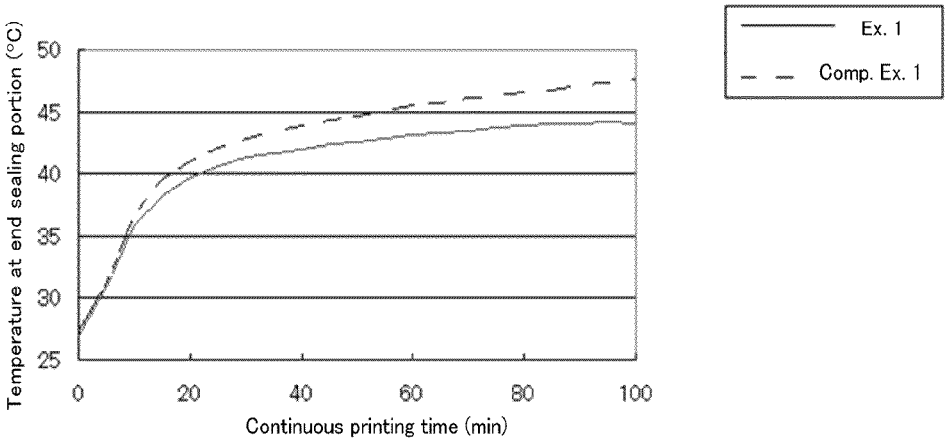
FIG. 9 is a plot illustrating temperature changes at a contact portion (end sealing portion) in continuous printing in Example 1 and Comparative Example 1.

A continuous printing was carried out using the image forming apparatus having an apparatus configuration described above, and temperature changes in the low-friction region at the contact portion (end sealing portion) were measured. Results are shown in FIG. 9.

Also, a full solid image was printed on 5,000 sheets of A4-size recording paper.

Comparative Example 1

An image forming apparatus was prepared in the same manner as Example 1 except that the low-friction region 1911 was not formed, that is, the felt was not coated with DRY-SURF MF-2400EL manufactured by HARVES Co., Ltd. (liquid including a fluorine-based resin), and the continuous printing was carried out.

Temperature changes at the contact portion (end sealing portion) after the continuous printing were measured. Results are shown in FIG. 9.

Comparative Example 2

Figure 10:
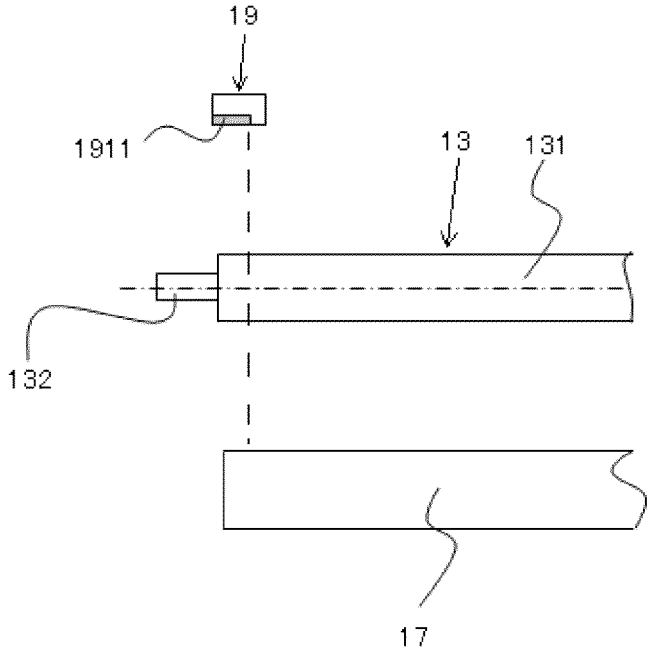
FIG. 10 is a schematic diagram illustrating a positional relationship among a toner bearing member, a seal and a cleaning unit in an image forming apparatus of Comparative Example 2.

An image forming apparatus was prepared in the same manner as Example 1 except that the positional relationship among the toner bearing member 13, the seal 19 and the cleaning blade 17 in Example 1 was changed to that illustrated in FIG. 10 (the circumferential surface of the roller portion 131 which contacted the low-friction region 1911 of the seal 19 was arranged so as to face the contact region of the cleaning blade 17 with the photoconductor), and the continuous printing was carried out. Temperature changes at the contact portion (edge sealing portion) after the continuous printing were measured.

Also, a full solid image was printed on 5,000 sheets of A4-size recording paper.

Results of Example 1, Comparative Examples 1 to 2

Temperature Changes at End Sealing Portion

The measurement results of the temperature changes at the contact portion (end sealing portion) after the continuous printing in Example 1 and Comparative Examples 2 are illustrated in FIG. 9.

Compared to the temperature of the end sealing portion during continuous printing in Comparative Example 1, the temperature of the end sealing portion during continuous printing in Example 1 was lower by about 3° C. as a saturated temperature. Also, in Comparative Example 1, after completion of the continuous printing (100 minutes), toner fixing derived from excessive temperature increase around the regulating member 14 occurred, and an occurrence of toner scattering was confirmed from a gap formed by the lifted regulating member 14. On the other hand, such toner scattering was not observed in Example 1. Comparative Example 2 was similar to Example 1.

<<Abnormality in Photoconductor>>

The surface of the photoconductor was observed after printing 5,000 sheets. It was confirmed in Comparative Example 2 that a part of components of the fluorine-based resin formed in the low-friction region moved to the photoconductor and further spread inward in an axial direction of the photoconductor while being scraped by the cleaning blade. After the photoconductor in that state was stored for 3 days, a part of components of the fluorine-based resin altered the photoconductor, and white streaks were observed at both ends of an image in a cycle around the photoconductor.

On the other hand, there was no spreading of the fluorine-based resin on the photoconductor by the cleaning blade in Example 1, and no abnormal image such as white streaks at both ends of an image was observed.

Aspects of the present invention are as follows.

<1> A developing apparatus, used in an image forming apparatus including a photoconductor and a cleaning unit which removes a toner remaining on the photoconductor, wherein the developing apparatus includes:

a developer container with a toner outlet formed facing the photoconductor;

a toner bearing member including a roller portion arranged at the toner outlet, which bears a toner on a surface thereof and supplies the toner to an electrostatic latent image on a surface of the photoconductor in a developing region facing the photoconductor;

a seal arranged at both ends of the toner outlet so as to contact an outer periphery of the roller portion at both ends thereof in a longitudinal direction;

a regulating member which regulates an amount of the toner towards the developing region, wherein the regulating member is contacted by the roller portion such that a space between the toner outlet and the outer periphery of the roller portion is blocked in an upstream side from the developing region in a direction of rotation of the toner bearing member; and a development entrance sealing member contacted by the roller portion such that the space between the toner outlet and the outer periphery of the roller portion is blocked in a downstream side from the developing region in the direction of rotation of the toner bearing member, wherein the seal includes a contact portion which contacts the roller portion, wherein the contact portion includes a low-friction region including a material on at least a part of a contact surface with the roller portion, wherein the low-frictional region including the material has frictional resistance between the contact surface and the roller portion lower than frictional resistance between the contact portion without the material and the roller portion, and the material reduces the frictional resistance at the contact surface, and wherein a circumferential surface of the roller portion contacting the low-friction region is arranged to face outward in a longitudinal direction of the photoconductor from the contact region of the cleaning unit with the photoconductor.

<2> The developing apparatus according to <1>, wherein the material which reduces the frictional resistance is a fluorine-based resin.

<3> The developing apparatus according to any one of <1> to <2>, wherein the contact portion is formed using felt.

<4> The developing apparatus according to any one of <1> to <3>, wherein the seal includes a first resilient portion and a second resilient portion, each of which generate a repulsive force at the contact portion in contact with the roller portion, and wherein the repulsive force generated by the second resilient portion is smaller than that generated by the first resilient portion.

<5> The developing apparatus according to any one of <1> to <4>, wherein the contact portion is in contact with the regulating member, and wherein a contact pressure between the contact portion and the regulating member is smaller than a contact pressure between the contact portion and the roller portion.

<6> An image forming apparatus, including:

a photoconductor;

a developing unit which forms a visible image by developing an electrostatic latent image formed on the photoconductor; and a cleaning unit which removes a toner remaining on the photoconductor, wherein the developing apparatus includes:

a developer container with a toner outlet formed facing the photoconductor;

a toner bearing member including a roller portion arranged at the toner outlet, which bears a toner on a surface thereof and supplies the toner to an electrostatic latent image on a surface of the photoconductor in a developing region facing the photoconductor;

a seal arranged at both ends of the toner outlet so as to contact an outer periphery of the roller portion at both ends thereof in a longitudinal direction;

a regulating member which regulates an amount of the toner towards the developing region, wherein the regulating member is contacted by the roller portion such that a space between the toner outlet and the outer periphery of the roller portion is blocked in an upstream side from the developing region in a direction of rotation of the toner bearing member; and a development entrance sealing member contacted by the roller portion such that the space between the toner outlet and the outer periphery of the roller portion is blocked in a downstream side from the developing region in the direction of rotation of the toner bearing member, wherein the seal includes a contact portion which contacts the roller portion, wherein the contact portion includes a low-friction region including a material on at least a part of a contact surface with the roller portion, wherein the low-frictional region including the material has frictional resistance between the contact surface and the roller portion lower than frictional resistance between the contact portion without the material and the roller portion, and the material reduces the frictional resistance at the contact surface, and wherein a circumferential surface of the roller portion contacting the low-friction region is arranged to face outward in a longitudinal direction of the photoconductor from the contact region of the cleaning unit with the photoconductor.

<7> The image forming apparatus according to <6>, wherein the material which reduces the frictional resistance is a fluorine-based resin.

<8> The image forming apparatus according to any one of <6> to <7>, wherein the contact portion is formed using felt.

<9> The image forming apparatus according to any one of <6> to <8>, wherein the seal includes a first resilient portion and a second resilient portion, each of which generate a repulsive force at the contact portion in contact with the roller portion, and wherein the repulsive force generated by the second resilient portion is smaller than that generated by the first resilient portion.

<10> The image forming apparatus according to <6> to <9>, wherein the contact portion is in contact with the regulating member, and wherein a contact pressure between the contact portion and the regulating member is smaller than a contact pressure between the contact portion and the roller portion.

<11> A process cartridge, including:

a photoconductor; and a developing apparatus, wherein the process cartridge is detachably attached to an image forming apparatus main body, wherein the developing apparatus is used in an image forming apparatus including a photoconductor and a cleaning means for removing a toner remaining on the photoconductor, wherein the developing apparatus includes:

a toner bearing means including a roller portion arranged at the toner outlet, for bearing a toner on a surface thereof and for supplying the toner to an electrostatic latent image on a surface of the photoconductor in a developing region facing the photoconductor;

a sealing means arranged at both ends of the toner outlet for contacting an outer periphery of the roller portion at both ends thereof in a longitudinal direction;

a regulating means for regulating an amount of the toner towards the developing region, wherein the regulating means is contacted by the roller portion such that a space between the toner outlet and the outer periphery of the roller portion is blocked in an upstream side from the developing region in a direction of rotation of the toner bearing means; and a development entrance sealing means contacted by the roller portion for blocking the space between the toner outlet and the outer periphery of the roller portion in a downstream side from the developing region in a direction of rotation of the toner bearing means, wherein the sealing means includes a contact portion which contacts the roller portion, wherein the contact portion includes a low-friction region including a material on at least a part of a contact surface with the roller portion, wherein the low-frictional region including the material has frictional resistance between the contact surface and the roller portion lower than frictional resistance between the contact portion without the material and the roller portion, and the material reduces the frictional resistance at the contact surface, and wherein a circumferential surface of the roller portion contacting the low-friction region is arranged to face outward in a longitudinal direction of the photoconductor from a contact region of the cleaning means with the photoconductor.

<12> The process cartridge according to <11>, wherein the material which reduces the frictional resistance is a fluorine-based resin.

<13> The process cartridge according to any one of <11> to <12>, wherein the contact portion is formed using felt.

<14> The process cartridge according to any one of <11> to <13>, wherein the seal includes a first resilient portion and a second resilient portion, each of which generate a repulsive force at the contact portion in contact with the roller portion, and wherein the repulsive force generated by the second resilient portion is smaller than that generated by the first resilient portion.

<15> The process cartridge according to any one of <11> to <14>, wherein the contact portion is in contact with the regulating member, and wherein a contact pressure between the contact portion and the regulating member is smaller than a contact pressure between the contact portion and the roller portion.

This application claims priority to Japanese application No. 2012-049160, filed on Mar. 6, 2012 and incorporated herein by reference.

What is claimed is:

1. A developing apparatus, used in an image forming apparatus comprising a photoconductor and a cleaning unit which removes a toner remaining on the photoconductor, wherein the developing apparatus comprises:

a developer container with a toner outlet formed facing the photoconductor;

a toner bearing member comprising a roller portion arranged at the toner outlet, which bears a toner on a surface thereof and supplies the toner to an electrostatic latent image on a surface of the photoconductor in a developing region facing the photoconductor;

a seal arranged at both ends of the toner outlet so as to contact an outer periphery of the roller portion at both ends thereof in a longitudinal direction;

a regulating member which regulates an amount of the toner towards the developing region, wherein the regulating member is contacted by the roller portion such that a space between the toner outlet and the outer periphery of the roller portion is blocked in an upstream side from the developing region in a direction of rotation of the toner bearing member; and a development entrance sealing member contacted by the roller portion such that the space between the toner outlet and the outer periphery of the roller portion is blocked in a downstream side from the developing region in the direction of rotation of the toner bearing member, wherein the seal comprises a contact portion which contacts the roller portion, wherein the contact portion comprises a low-friction region comprising a material on at least a part of a contact surface with the roller portion, wherein the low-frictional region comprising the material has frictional resistance between the contact surface and the roller portion lower than frictional resistance between the contact portion without the material and the roller portion, and the material reduces the frictional resistance at the contact surface, and wherein a circumferential surface of the roller portion contacting the low-friction region is arranged to face outward in a longitudinal direction of the photoconductor from the contact region of the cleaning unit with the photoconductor.

2. The developing apparatus according to claim 1, wherein the material which reduces the frictional resistance is a fluorine-based resin.

3. The developing apparatus according to claim 1, wherein the contact portion is formed using felt.

4. The developing apparatus according to claim 1, wherein the seal comprises a first resilient portion and a second resilient portion, each of which generate a repulsive force at the contact portion in contact with the roller portion, and wherein the repulsive force generated by the second resilient portion is smaller than that generated by the first resilient portion.

5. The developing apparatus according to claim 1, wherein the contact portion is in contact with the regulating member, and wherein a contact pressure between the contact portion and the regulating member is smaller than a contact pressure between the contact portion and the roller portion.

6. An image forming apparatus, comprising:

a photoconductor;

a developing unit which forms a visible image by developing an electrostatic latent image formed on the photoconductor; and a cleaning unit which removes a toner remaining on the photoconductor, wherein the developing unit comprises a developer container with a toner outlet formed facing the photoconductor;

a toner bearing member comprising a roller portion arranged at the toner outlet, which bears a toner on a surface thereof and supplies the toner to an electrostatic latent image on a surface of the photoconductor in a developing region facing the photoconductor;

a seal arranged at both ends of the toner outlet so as to contact an outer periphery of the roller portion at both ends thereof in a longitudinal direction;

a regulating member which regulates an amount of the toner towards the developing region, wherein the regulating member is contacted by the roller portion such that a space between the toner outlet and the outer periphery of the roller portion is blocked in an upstream side from the developing region in a direction of rotation of the toner bearing member; and a development entrance sealing member contacted by the roller portion such that the space between the toner outlet and the outer periphery of the roller portion is blocked in a downstream side from the developing region in the direction of rotation of the toner bearing member, wherein the seal comprises a contact portion which contacts the roller portion, wherein the contact portion comprises a low-friction region comprising a material on at least a part of a contact surface with the roller portion, wherein the low-frictional region comprising the material has frictional resistance between the contact surface and the roller portion lower than frictional resistance between the contact portion without the material and the roller portion, and the material reduces the frictional resistance at the contact surface, and wherein a circumferential surface of the roller portion contacting the low-friction region is arranged to face outward in a longitudinal direction of the photoconductor from the contact region of the cleaning unit with the photoconductor.

7. The image forming apparatus according to claim 6, wherein the material which reduces the frictional resistance is a fluorine-based resin.

8. The image forming apparatus according to claim 6, wherein the contact portion is formed using felt.

9. The image forming apparatus according to claim 6, wherein the seal comprises a first resilient portion and a second resilient portion, each of which generate a repulsive force at the contact portion in contact with the roller portion, and wherein the repulsive force generated by the second resilient portion is smaller than that generated by the first resilient portion.

10. The image forming apparatus according to claim 6, wherein the contact portion is in contact with the regulating member, and wherein a contact pressure between the contact portion and the regulating member is smaller than a contact pressure between the contact portion and the roller portion.

11. A process cartridge, comprising:

a photoconductor; and a developing apparatus, wherein the process cartridge is detachably attached to an image forming apparatus main body, wherein the developing apparatus is used in an image forming apparatus comprising a photoconductor and a cleaning means for removing a toner remaining on the photoconductor, wherein the developing apparatus comprises:

a toner bearing means comprising a roller portion arranged at the toner outlet, for bearing a toner on a surface thereof and for supplying the toner to an electrostatic latent image on a surface of the photoconductor in a developing region facing the photoconductor;

a sealing means arranged at both ends of the toner outlet for contacting an outer periphery of the roller portion at both ends thereof in a longitudinal direction;

a regulating means for regulating an amount of the toner towards the developing region, wherein the regulating means is contacted by the roller portion such that a space between the toner outlet and the outer periphery of the roller portion is blocked in an upstream side from the developing region in a direction of rotation of the toner bearing means; and a development entrance sealing means contacted by the roller portion for blocking the space between the toner outlet and the outer periphery of the roller portion in a downstream side from the developing region in a direction of rotation of the toner bearing means, wherein the sealing means comprises a contact portion which contacts the roller portion, wherein the contact portion comprises a low-friction region comprising a material on at least a part of a contact surface with the roller portion, wherein the low-frictional region comprising the material has frictional resistance between the contact surface and the roller portion lower than frictional resistance between the contact portion without the material and the roller portion, and the material reduces the frictional resistance at the contact surface, and wherein a circumferential surface of the roller portion contacting the low-friction region is arranged to face outward in a longitudinal direction of the photoconductor from a contact region of the cleaning means with the photoconductor.

12. The process cartridge according to claim 11, wherein the material which reduces the frictional resistance is a fluorine-based resin.

13. The process cartridge according to claim 11, wherein the contact portion is formed using felt.

14. The process cartridge according to claim 11, wherein the sealing means comprises a first resilient portion and a second resilient portion, each of which generate a repulsive force at the contact portion in contact with the roller portion, and wherein the repulsive force generated by the second resilient portion is smaller than that generated by the first resilient portion.

15. The process cartridge according to claim 11, wherein the contact portion is in contact with the regulating means, and wherein a contact pressure between the contact portion and the regulating means is smaller than a contact pressure between the contact portion and the roller portion.

* * * * *